United States Patent [19]

Imamura

[11] 4,023,345

[45] May 17, 1977

[54] ELECTRONIC TIMEPIECE

[75] Inventor: Youichi Imamura, Suwa, Japan

[73] Assignee: Kabushiki Kaisha Suwa Seikosha, Tokyo, Japan

[22] Filed: Nov. 25, 1975

[21] Appl. No.: 635,022

[30] Foreign Application Priority Data

Nov. 25, 1974 Japan ..... 49-135324

[52] U.S. Cl. ..... 58/39.5; 58/74

[51] Int. Cl.² ..... G10F 8/00; G10F 10/00

[58] Field of Search ..... 58/23 R, 39.5, 50 R, 58/74, 85.5, 152 R, 153

[56] References Cited

UNITED STATES PATENTS

| | | | |
|---|---|---|---|
| 3,686,880 | 8/1972 | Samejima | 58/39.5 |
| 3,757,509 | 9/1973 | Fujita | 58/23 R |
| 3,789,600 | 2/1974 | Champan | 58/39.5 |
| 3,795,099 | 3/1974 | Tsuruishi | 58/23 R |
| 3,854,277 | 12/1974 | Samejima et al. | 58/39.5 |
| 3,934,400 | 1/1976 | Nishimura et al. | 58/23 R |
| 3,950,935 | 4/1976 | Naito | 58/39.5 |

*Primary Examiner*—Stanley J. Witkowski

*Attorney, Agent, or Firm*—Blum, Moscovitz, Friedman & Kaplan

[57] ABSTRACT

A digital display electronic stop-watch control circuit for facilitating the control of the start, stop, lap and reset functions in an electronic stop-watch is provided. The control circuit is provided for use in an electronic timepiece having counter circuitry for producing elapsed time signals, memory circuitry for storing said elapsed time signals and display circuitry for displaying either elapsed time or stored time in response to the elapsed time signals produced by the counter circuitry or in response to the stored time signals produced by the memory circuitry being respectively applied thereto. The control circuit of the instant invention is characterized by being coupled to the counter circuitry, memory circuitry and digital display circuitry. First and second manually operated switching circuits are respectively coupled to the control circuit. The control circuit in response to an initial actuation of the first switching circuit starts the count of the counter circuit and in response to the next actuation of the first switching circuit inhibits the count of the counter circuit. The control circuit, in response to an initial actuation of the second switching circuit when such actuation occurs during the interval between an initial actuation of the first switching circuit and a next actuation of the first switching circuit terminates the application of elapsed time signals to the memory circuit, and changes the digital display circuitry to display time in response to the stored time signals in the memory circuitry and in response to the next actuation of the second switching circuit returns the digital display circuitry to displaying time in response to the elapsed time signals produced by the counter circuit.

10 Claims, 4 Drawing Figures

ELECTRONIC TIMEPIECE

BACKGROUND OF THE INVENTION

This invention is directed to a control circuit for an electronic digital display wristwatch and in particular to a control circuit for facilitating the operation of a digital display electronic stop-watch.

While stop-watches have taken on various forms, aside from the single elapsed time measurement function achieved by all mechanical stop-watches, such measurement functions as measuring elapsed times, portions of the total elapsed time, two coextensive or partially coextensive elapsed periods of time, and the like, are satisfactorily obtainable in mechanical stop-watches. Primarily, it is not possible to provide such information in a mechanical stop-watch since only a single time measurement mechanism is provided. Moreover, each of the respective functions requires an additional winding crown to achieve such functions. Accordingly, it is necessary to utilize a digital display electronic timepiece in order to provide each of the respective functions. Nevertheless, although winding crowns are not needed on an electronic timepiece, the greater the number of functions performed thereby the greater the number of switches required to control such functions. Accordingly, a control circuit for operating a digital display electronic stop-watch, which circuit is operated by a minimum number of switches is desired.

SUMMARY OF THE INVENTION

Generally speaking, in accordance with the invention, an electronic digital display wristwatch control circuit is provided. The wristwatch includes a counter circuit for producing elapsed time signals, a memory circuit coupled to the counter circuit for storing elapsed time signals, and a digital display circuit for displaying either the elapsed time signals produced by the counter circuit or the stored time signals produced by the memory circuit. First and second manually operated switching circuits are coupled to the control circuit. The control circuit is coupled to counter circuit, memory circuit and display circuit. The control circuit in response to an initial actuation of the first switching circuit is adapted to apply a start signal to the counter circuit to start same counting and in response to the next actuation of the first switching circuit to apply an inhibit signal to the counter circuit to inhibit same from counting. The control circuit in response to an initial actuation of the second control circuit between the initial actuation of the first switching circuit and the next actuation of the first switching circuit is adapted to apply a lap signal to the memory circuit to inhibit application of elapsed time signals thereto and is further adapted to apply a lap display signal to the digital display means to effect application of the stored time signals in the memory circuit thereto. The control circuit in response to the next actuation of the second switching circuit applies an end of lap signal to the digital display circuit to return same to once again receiving the elapsed time signals produced by the counter circuit. The control circuit in response to an initial actuation of the second switching circuit at a time other than between the first and second actuations of the first switching circuit being adapted to apply an adjustment pulse to the counter circuit to adjust the count thereof to zero.

Accordingly, it is an object of this invention to provide an improved control circuit for a digital display electronic stop-watch.

Another object of the instant invention is to provide a stop-watch control circuit for facilitating the measurement of a first period of time and several shorter periods of time within the first period of time.

Still a further object of the instant invention is to provide an improved electronic stop-watch control circuit capable of maximizing the stop-watch functions and minimizing the number of switches required to effect such stop-watch functions.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
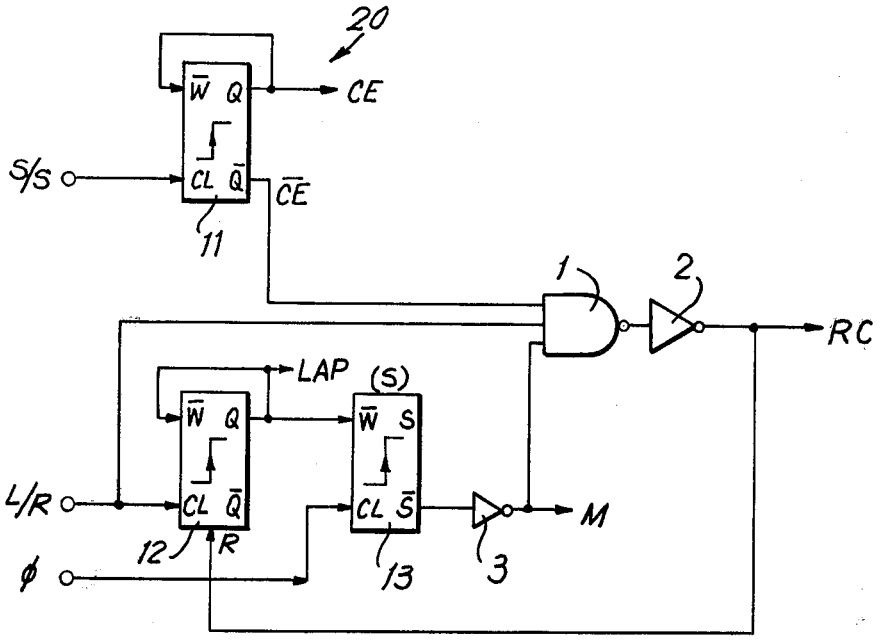
FIG. 1 is a block circuit diagram of a digital display electronic stop-watch control circuit constructed in accordance with a preferred embodiment of the instant invention.

Referring now to FIG. 1, a control circuit, generally indicated as 20, for use in a digital display electronic stop-watch is depicted. Binary flip-flops 11 and 12 are adapted to respectively receive START-STOP signal S/S and LAP-RESET signal L/R at the respective clock input terminals CL thereof. The output signal of the Q terminals, CE and LAP of flip-flops 11 and 12, respectively, are fed back to the respective write-in inputs. As noted in FIG. 1, the output Q of the respective flip-flops changes state in response to a rising leading edge of the respective input pulse signals S/S and L/R applied thereto. Additionally, flip-flop 12 includes a reset terminal R adapted to receive a reset pulse RC, to be explained in greater detail below. START-STOP pulse signal S/S and LAP-RESET pulse signal L/R are generated by processing circuits in response to the manual actuation of a switch. The processing circuits, which processing circuits are not part of the instant invention, synchronize the respective pulses with a high frequency pulse $\phi$, it being necessary for the frequency of the synchronizing pulse $\phi$ to be greater than the frequency of the smallest period of time to be measured by the stop-watch in order to insure the accuracy and reliability of the control circuit and the stop-watch functions performed thereby.

Synchronizing pulse $\phi$ is applied to the clock input CL of slave flip-flop 13 (S), which flip-flop produces a changed binary state mask signal M upon the application of a rising leading edge of the clock pulse after each change of state of the output signal LAP produced at the Q terminal of flip-flop 12 and applied to the write-in terminal $\overline{W}$ of slave flip-flop 13. Finally, a NAND gate 1 is coupled to flip-flop 11 to receive as a first input the $\overline{Q}$ output $\overline{CE}$ from flip-flop 11. The NAND gate receives as a second input, the LAP-RESET signal L/R, and as a third input, mask signal M, which signal is applied to NAND gate 1 by inverter circuit 3 and therefore is the complement of the output of the $\overline{S}$ terminal of flip-flop 13. In response to each of the input signals received by NAND gate 1 having a coincident 1 binary state, the NAND gate applies a 0 binary state signal to inverter circuit 2. Inverter circuit 2 produces a 1 binary state signal RC, which signal RC is additionally fed back to the reset terminal R of flip-flop 13 to reset same.

Figure 4:
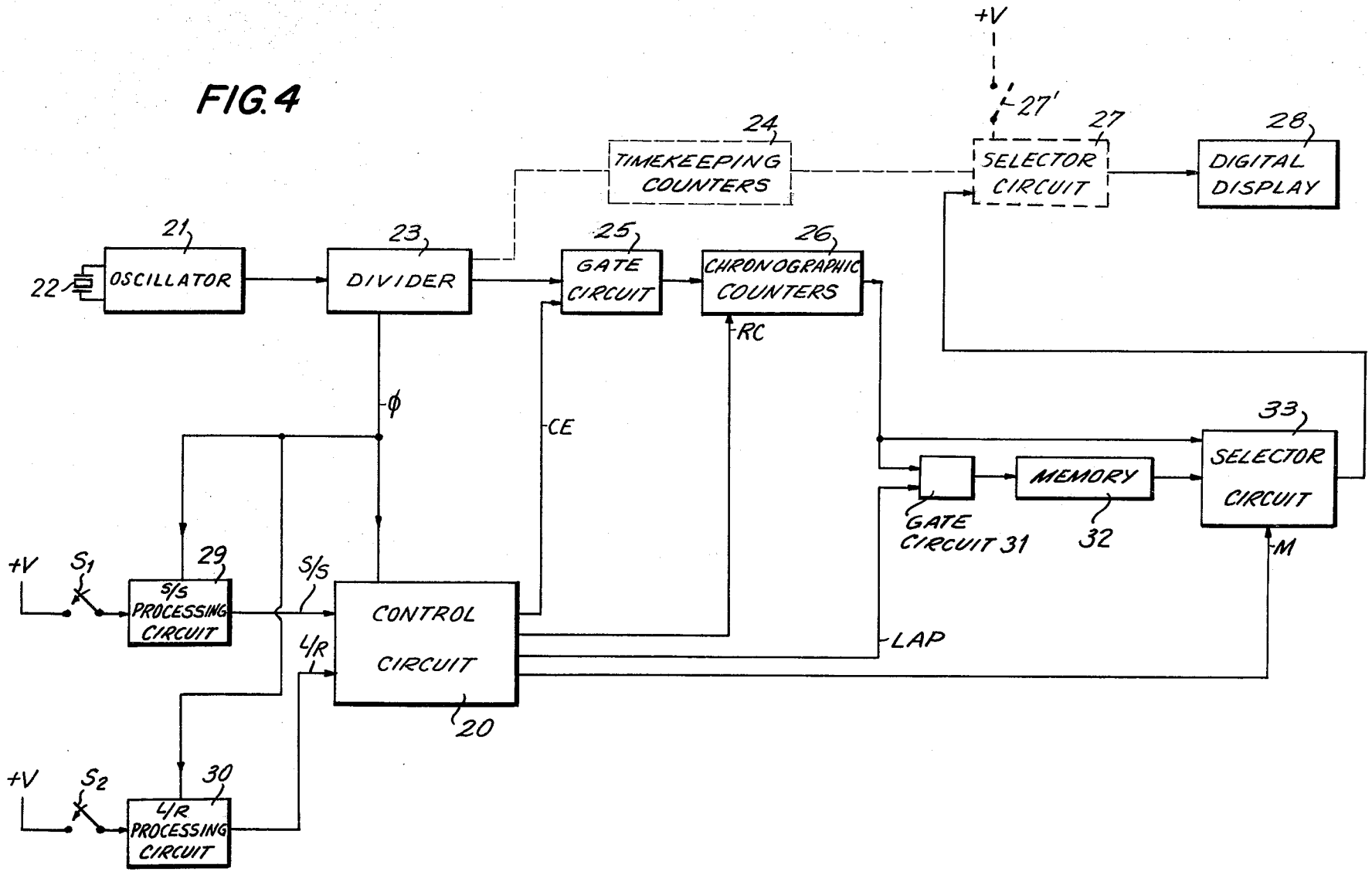
FIG. 4 is a block circuit diagram of an electronic chronographic wristwatch incorporating the control circuit depicted in FIG. 1.

Reference is now made to FIG. 4, wherein an electronic chronographic wristwatch of the type with which the control circuit 20 of the instant invention is to be utilized is depicted. It is noted that the chronographic wristwatch illustrated in FIG. 4 is well-known in the art and is of the type illustrated and described in U.S. Pat. No. 3,795,099, issued on Mar. 5, 1974, and is presented in FIG. 4 by way of example only to facilitate an understanding of the operation of the control circuit 20 in such a timepiece. Specifically, the oscillator circuit 21 includes a quartz crystal vibrator 22 as a time standard, and produces a high frequency time standard signal. The high frequency time standard signal produced by the oscillator circuit 21 is received by a divider circuit 23, which divider circuit produces an intermediate frequency signal $\phi$ and additionally applies a low frequency timekeeping signal through gate circuit 25 to the chronographic counters 26. Additionally, timekeeping counters 24 are illustrated in dotted lines and can also be provided for receiving an output signal from the divider 23 when it is desired to provide a chronographic timepiece which is not only capable of chronographic operation but additionally is designed to avoid any interruption of the timekeeping operation of the timepiece during operation of same as a stopwatch. To this end, a selector circuit 27 is also shown in phantom, and is coupled to a selector switch 27′ which selector switch is utilized to select the output from the timekeeping counters 24 or the signals from the stopwatch mechanism.

Gate circuit 25 is adapted to selectively gate the output from divider circuit 23 to the chronograph counters 26 in response to the start-inhibit signal CE applied thereto. As detailed herein, for the control circuit depicted in FIG. 1, gate circuit 25 would be an AND gate. The chronographic counters 26 include a plurality of series-connected divider stages adapted to receive the gated timekeeping signal produced by divider 23 and in response thereto apply signals representative of elapsed time to the selector circuit 33 and through the gate circuit 31 to memory 32. Accordingly, each of the respective divider stages comprising the chronograph counters 26 would have the reset to zero signal RC applied to the reset terminal thereof to effect resetting of the count thereof to zero. The output of memory 32 is applied to selector circuit 33 which selector circuit is controlled by mask signal M and applies to the selector circuit 27 or to the digital display circuitry 28 the output of either the elapsed time signals produced by the chronographic counters 26 or the most recently stored elapsed time signals stored in memory 32. As noted above, the output of selector circuit 33 is directly coupled to the digital display circuitry 28 and the selector circuit 27 is eliminated when a separate timekeeping counter circuit 24 is not utilized. Digital display circuit 28 includes the necessary decoder, driving and digital display elements to form a conventional seven-bar display. Finally, manually operated function selecting switches $S_1$ and $S_2$ are respectively coupled to S/S processing circuit 29 and L/R processing circuit 30, which processing circuits receive synchronizing pulse $\phi$ from the divider 23 and produce START-STOP pulse signals S/S and LAP-RESET pulse signals L/R in a conventional manner.

Figure 2:
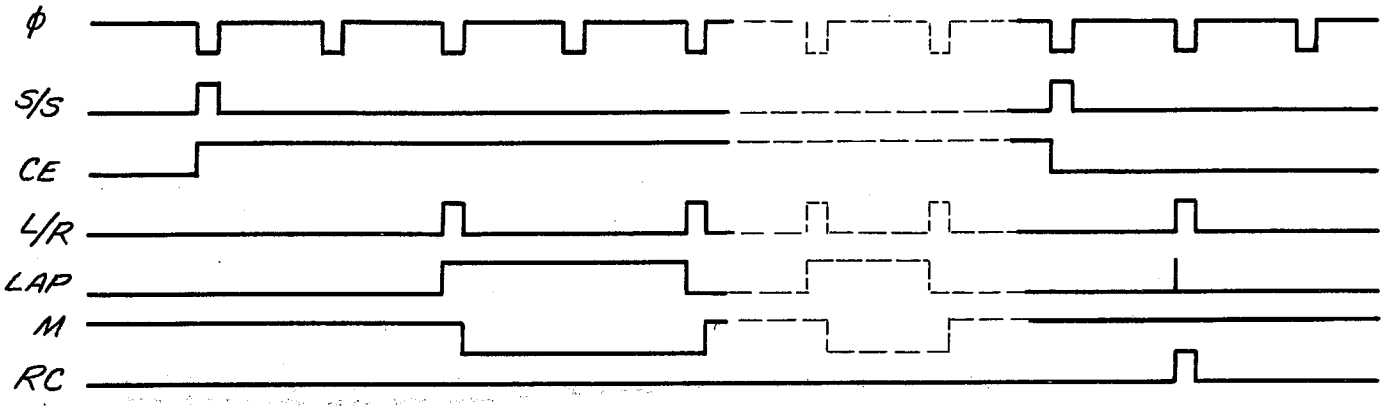
FIGS. 2 and 3 are respective wave diagrams illustrating two different modes of operation of the control circuit depicted in FIG. 1.

Reference is now made to FIG. 2 wherein a first mode of operation of the control circuit depicted in FIG. 1 is illustrated. In response to an initial application of a START-STOP pulse S/S to flip-flop 11, the binary state of the start-inhibit signal CE is changed from 0 to 1. The start-inhibit signal is applied to a gate circuit intermediate the divider producing low frequency timekeeping signals and the chronographic counters and effects a commencement of the count of the chronographic counters by gating the timekeeping pulses thereto. Accordingly, the chronographic counters continue to count until the next START-STOP pulse S/S is applied to flip-flop 11, to change the start-inhibit signal to a 0 binary state and apply signal CE to gate circuit 25 to thereby inhibit the application of any further timekeeping signals produced by divider circuit 23 to the chronographic counters 26. Accordingly, in response to each initial application of a START-STOP pulse S/S to flip-flop 11, a counter start signal is applied, and in response to the application of the next START-STOP pulse S/S, an inhibit signal is applied to the chronographic counter.

As noted above, in response to a LAP-RESET pulse L/R being applied to flip-flop 12, a change in state of the LAP output signal is effected. Specifically, in response to the initial application of the LAP-RESET pulse to the flip-flop 12, the LAP signal is changed from a 0 state to a 1 state. As illustrated in FIG. 4, the LAP signal is applied to gate circuit 31. When the LAP signal is in a 0 state, gate circuit 31 remains open and applies the elapsed time signals produced by the chronographic counters 26 to the memory circuit 32. However, upon the LAP signal changing from a 0 state to a 1 state, the gate circuit 31 inhibits the application of the elapsed time signals from chronograhic counters 26 to memory circuit 32 and thereby leaves the last elapsed time signals stored in the memory 32 therein. Additionally, the LAP signal is applied to the slave flip-flop 13, which signal upon the next rising leading edge of the clock pulse $\phi$ changes the state of mask signal M, which signal is produced by the slave output $\overline{S}$ of flip-flop 13 and is inverted by inverter 3, from a 1 state to a 0 state. Accordingly, mask signal M in a 1 state effects application of the elapsed time signals produced by chronographic counters 26 to the digital display 28 to effect a display of the time measured by the chronographic counters 26. However, upon application of a 0 state M signal to the selector circuit 33, the elapsed time signals last stored in memory 32 are applied to the digital display circuitry 28 and are displayed, such elapsed time signals representing the lap time at the moment that the initial LAP-RESET pulse L/R is applied to the control circuit 20. As is further noted in FIG. 2 upon the next application of a LAP-RESET pulse to the flip-flop 12, the state of the LAP signal is once again returned to a 0 state to thereby reopen gate circuit 31 and permit the elapsed time signals produced by chronographic counters 26 to be applied to the memory 32. Similarly, upon the next rising leading edge of clock pulse $\phi$, the state of mask signal M is changed, thereby changing the signals applied to the digital display 28 by selector circuit 33 from the elapsed time signals stored in the memory 32 to the elapsed time signals being produced by the chronographic counters 26. As is noted in FIG. 2, the chronographic counters 26 continue to count and measure elapsed time even though the lap time has been displayed. Accordingly, as is illustrated by the dashed line in FIG. 2, any number of lap times can be displayed during the period that the chronographic counters are measuring or counting time and producing elapsed time signals. As illustrated in FIG. 2, after the second START-STOP pulse S/S has been applied, and an even number of LAP-RESET pulses have been applied to control circuit 20, the next LAP-RESET pulse applied to flip-flop 12 also applies a 1 binary state signal to NAND gate 1. Since the start-inhibit signal has been changed to a 0 state to inhibit the chronographic counters from counting, the complement thereof $\overline{CE}$ applied to the NAND gate 1 is also in a 1 binary state. Finally, mask signal M is in the 1 binary state since no lap signal is being displayed. Accordingly, in response to the application of the 1 binary state LAP-RESET signal, mask signal M, and signal $\overline{CE}$, inverter circuit 2 receives a 0 state signal and produces a 1 start to zero signal RC which signal is applied to flip-flop 12 to immediately reset same back to zero. Additionally start to zero signal RC is applied to each of the chronographic counter divider stage reset terminals to reset the count thereof to zero. It is noted that in the event that the chronographic counters count in a subtraction counting mode rather than in an addition counting mode, the signal RC would be applied to the set to one terminals of each of the divider stages comprising the chronographic counters 26. Thus, only two control switches are needed to produce the time measurement, lap and reset to zero functions in a digital display electronic stop-watch.

Figure 3:
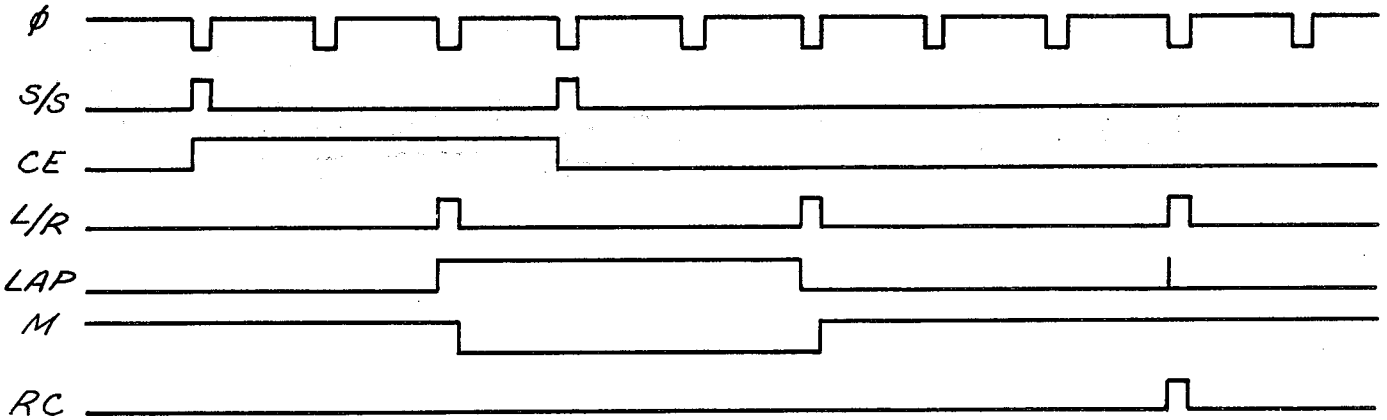

Reference is now made to FIG. 3, wherein an operating mode wherein the second START-STOP pulse S/S is applied after the initial application of a LAP-RESET pulse L/R but before the application of a second LAP-RESET pulse for returning the digital display from displaying lap time to elapsed time is depicted. In response to the second STOP-START pulse S/S applied to the control circuit 20, the count of the chronographic counters will be inhibited. Nevertheless, since the next LAP-RESET pulse L/R has not been applied to the control circuit 20, the lap time will continue to be displayed. Accordingly, upon application of the second LAP-RESET pulse, a 1 binary state mask signal M is applied to selector circuit 33 to thereby recouple the chronographic counters 26 to the digital display 28 and effect a digital display of the last count of the chronographic counters 26 when the count of same was inhibited. As in the embodiment depicted in FIG. 2, resetting of the chronographic counters 26 cannot be effected until after both START-STOP pulses and both LAP-RESET pulses have been applied to the control circuit 20. It is further noted that if the initial LAP-RESET pulse is not applied during the interval between the first and second START-STOP pulses, the chronographic counters will automatically be reset to zero by the initial LAP-RESET pulse.

It is noted that in the mode of operation depicted in FIG. 3, if the measurement of time is inhibited during display of a lap time, the lap time indication continues to be displayed and the elapsed time measured is not displayed until the indication of lap time is released by the next application of a LAP-RESET pulse. Accordingly, if two runners are timed by a stop-watch utilizing a control circuit in accordance with the instant invention, if the first START-STOP pulse has been applied to the control circuit, to thereby start the count of the chronographic counters, the first LAP-RESET pulse can be utilized to time the first runner, and the second STOP-START pulse can be utilized to time the second runner, the second runner's time not being displayed until the application of the second STOP-START pulse, thereby permitting two independent times to be measured by the same stop-watch. It is further noted that the stop-watch of the instant invention can be utilized to sum up a plurality of discontinuous measured time intervals among the functions provided thereby.

It is further noted that the control circuit of the instant invention is formed of conventional binary logic elements which are readily adapted to be monolithically integrated into a C-MOS circuit chip in which the remaining circuit elements of a chronographic timepiece of the type depicted in FIG. 4 are integrated. Moreover, as illustrated in FIG. 4, such a control circuit would be particularly suitable for use in a chronographic timepiece having chronographic and timekeeping divider functions.

Finally, the improved control circuit of the instant invention could be provided with a single switching circuit for producing a series of pulses to actuate the control circuit to selectively perform the same series of control operations illustrated in either FIG. 2 or FIG. 3 in response to each actuation of the switching. However, the use of only one switching circuit would permit only a predetermined series of operations at the manually selected actuation times. For example, a predetermined series of operations of the type illustrated in FIG. 2 in response to a single manually actuatable switch producing five control pulses would be as follows: first the count of the counter would be started in response to the first control pulse; second, the elapsed time signal being applied to the memory would be terminated to thereby effect a display by the digital display of the stored time in the memory; thirdly, the digital display would return to displaying elapsed time and the memory would once again store the elapsed time in response to the third control pulse; fourthly, the count of the divider would be inhibited; and finally, in response to the fifth control pulse, the count of the divider would be adjusted to zero. Alternatively, a predetermined series of operations of the type illustrated in FIG. 3, in response to five control pulses being applied in sequence by a single switch would be as follows: firstly, the count of the counter would be started in response to the first control pulse being applied thereto; secondly, the application of elapsed time signals to the memory and the display of the last signals stored in the memory in response to the second control pulse would occur; thirdly, the count of the counter would be inhibited in response to the third control signal; fourthly, the digital display would once again receive elapsed time signals and the memory would once again store the elapsed time signals in response to the fourth control pulse; and finally, in response to the fifth control pulse the count of the divider would be adjusted to zero to complete the sequence of operations.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention here described, and all statements of the scope of the invention which, as a matter of language, might be said to fall therebetween.

What is claimed is:

1. In an electronic timepiece wristwatch including counter means for producing elapsed time signals, memory means for selectively storing said elapsed time signals, and display means for selectively displaying one of elapsed time and stored time in response to one of said elapsed time signals produced by said counter means and said stored time signals stored in said memory means being respectively applied thereto, the improvement comprising control circuit means coupled to said counter means, memory means and display means, manually actuatable means coupled to said control circuit means for selectively seriatum applying five control pulses to said control circuit means, said control circuit means in response to said pulses being applied thereto, seriatum affecting, a starting of the count of said counter means in response to said first control pulse, terminating the application of said elapsed time signals to said memory means and effecting display of stored time in response to said stored time signals in said memory means by said display means in response to said second pulse, returning said display means to display said elapsed time signals and said memory means to storing said elapsed time signals in response to said third pulse, inhibiting the count of said divider means in response to said fourth pulse, and adjusting the count of said divider means to zero in response to said fifth pulse.

2. In an electronic timepiece including counter means for producing elapsed time signals, memory means for selectively storing said elapsed time signals and display means for selectively displaying one of elapsed time and stored time in response to one of said elapsed time signals produced by said counter means and said stored time signals stored in said memory means being respectively applied thereto, the improvement comprising control circuit means coupled to said counter means, memory means and display means, manually actuatable means coupled to said control circuit means for seriatum applying five control pulses to said control circuit means, said control circuit means in response to said pulses being seriatum applied thereto, effecting a starting of the count of said counter means in response to said first control pulse, terminating the application of said elapsed time signals to said memory means and effecting display of said last signal stored in said memory means by said display means in response to said second pulse, inhibiting the count of said counter means in response to said third signal, returning said display means to receive said elapsed time signals and said memory means to storing said elapsed time signals in response to said fourth pulse, and adjusting the count of said divider means to zero in response to said fifth pulse.

3. In an electronic timepiece including counter means for producing elapsed time signals, memory means coupled to said counter means for storing said elapsed time signals, and display means for displaying one of elapsed time and stored time in response to one of said elapsed time signals produced by said counter means and said stored time signals produced by said memory means being respectively applied thereto, the improvement comprising control circuit means coupled to said counter means, memory means and display means, and first and second manually-actuated switching means respectively coupled to said control circuit means, said control circuit means in response to an initial actuation of said first switching means applying a start signal to said counter means to start same counting, said control circuit means in response to the next actuation of said first switching means applying an inhibit signal to said counter means to inhibit same from counting, said control circuit means in response to an initial actuation of said second control circuit means between said first and second actuations of said first switching means being adapted to apply a lap signal to said memory means to inhibit application of said elapsed time signals to said memory means and to couple said display means to said memory means to display said stored time signals produced thereby, said control circuit means being further adapted in response to the next actuation of said second switching means to couple said display means to said counter means to display elapsed time signals produced thereby, said control means in response to an initial actuation of said second switching means at a time other than between said first and second actuations of said first switching means applying an adjustment signal to said counter means to adjust the count thereof to zero.

4. An electonic timepiece as claimed in claim 3, wherein said control circuit means is further adapted to apply a mask signal to said display means to couple said display means to said memory means and thereby permit said display means to display said stored time signals.

5. An electronic timepiece as claimed in claim 3, wherein said control means, in response to said next actuation of said second switching means, when said first actuation occurs between the first and second actuations of said first switching means, applies an end of lap signal to said memory means to once again permit said memory means to store said elapsed time signals produced by said counter means.

6. An electronic wristwatch as claimed in claim 5, wherein said control circuit means includes first flip-flop means coupled to said first switching means for applying said start signal to said counter means to start the count of same in response to an initial actuation of said first switching means and in response to said second actuation of said first switching means for applying said stop signal to said counter means to inhibit same from counting.

7. An electronic wristwatch as claimed in claim 6, and including second flip-flop means coupled to said second switching means, said second flip-flop means in response to a first actuation of said second switching means after the initial actuation of said first switching means but prior to the next actuation of said first switching means being adapted to apply said lap signal to said memory means to prevent further storing of said elapsed time signals therein and to couple said display means to said memory means and effect displaying of the last elapsed time signal stored therein.

8. An electronic wristwatch as claimed in claim 7, wherein said second flip-flop means in response to the next actuation of said second switching means after an initial actuation of said switch means between the initial and next actuation of the first switching means applies said end of lap signal to said memory means to once again permit said memory means to store said elapsed time signals therein, and further couple said display means to said counter means to effect display of said elapsed time signal produced by the counter means.

9. An electronic wristwatch as claimed in claim 8, wherein said control circuit means includes logic means for receiving the complement of said start signal applied to said counter means, and said signal produced by said second switching means and in response to the coincident binary state of said complement of said start signal and signal produced by said second switching means apply to an adjustment signal to said counter means to restart the count thereof to zero.

10. An electronic wristwatch as claimed in claim 9, wherein said first manually-actuated switching means is a STOP-START two position control switch and said second manually operated switching means is a two position LAP-RESET switch.

* * * * *